United States Patent [19]

Bryant et al.

[11] Patent Number: 4,733,551

[45] Date of Patent: Mar. 29, 1988

[54] PIPE EXPANDER

[75] Inventors: Warren E. Bryant, West Heidelberg; Terrence E. Stanley, Briar Hill, both of Australia

[73] Assignee: W.E.B. Tooling Pty Ltd., West Heidelberg, Australia

[21] Appl. No.: 912,049

[22] Filed: Sep. 25, 1986

[30] Foreign Application Priority Data

Oct. 10, 1985 [AU] Australia ..... PH02842

[51] Int. Cl.[4] ..... B21D 41/02

[52] U.S. Cl. ..... 72/393

[58] Field of Search ..... 72/355, 392, 393

[56] References Cited

U.S. PATENT DOCUMENTS

| | | | |
|---|---|---|---|
| 157,875 | 12/1874 | Sharpneck | 72/393 |
| 417,323 | 12/1889 | John | 72/393 |
| 691,446 | 1/1902 | Colby | 72/393 |
| 1,057,664 | 4/1913 | Patterson | 72/393 |
| 3,812,704 | 5/1974 | Kowal | 72/476 |

FOREIGN PATENT DOCUMENTS

| | | | |
|---|---|---|---|
| 2616324 | 10/1977 | Fed. Rep. of Germany | 72/393 |

*Primary Examiner*—Lowell A. Larson

*Attorney, Agent, or Firm*—Fitch, Even, Tabin & Flannery

[57] ABSTRACT

A pipe expander head and pipe expander is disclosed which comprises a housing 30, in which a pin 50 is mounted. The pin 50 has a tapered end 54 and is provided with a plurality of teeth 60. The teeth 60 mesh with a gear assembly 62, 66 and 68 which in turn are coupled to a handle 72. Upon rotation of the handle 72 the gear assembly 62, 66 and 68 is rotated to drive the pin to expand an expander head. The expander head includes a plurality of segments 39, 41, 43, 45, 47 and 49 which are coupled together with a circular spring 96. The expander head segments each include annular stepped expanding portions 72, 74, 76 and 78 and the stepped portions are provided with recesses 80 for accommodating a work piece to be expanded.

8 Claims, 13 Drawing Figures

PIPE EXPANDER

This invention relates to a pipe expander. Pipe expanders are used to expand the end of pipes to enable pipes to be coupled together or to expand an opening in the side of a pipe to enable another pipe to be inserted into that opening to form a T-piece. Although the pipe expander is primarily intended for expanding pipes, it should be understood that the pipe expander could be used to expand other generally cylindrical articles.

Conventional pipe expanders include a expander head which has a plurality of annular step portions which increase in diameter from the centre of the head to provide a plurality of expanding portions for expanding pipes of different diameters. In order to provide a number of expanding portions it is necessary for the expander head to be made relatively thick to ensure that the side wall of the annular step portions is sufficiently large enough to support and expand the end of a pipe. Since it is necessary for the expander head of conventional pipe expanders to be relatively thick, conventional expanders have limited applicability to expanding openings in the side of pipes for enabling a further pipe to be joined in the opening to form a T-piece or for expanding other articles which have limited room for enabling the expander head to be inserted thereinto. For example, in the case of an opening in a pipe which is to be used to form a T-piece, it is necessary for the expander head to be inserted into the opening and in view of the large thickness of the expander head, the expander head can generally only be used for expanding small side openings in the wall of the pipe because the expander head abuts the opposite extremity of the pipe wall thereby preventing the pipe from being inserted onto the expander head to engage the larger diameter expanding portions.

Furthermore, conventional pipe expanders also take a considerable amount of time to complete an expanding operation.

It is an object of this invention to provide a pipe expander and a pipe expander head which is more flexible in its use as compared to conventional expanders and expander heads and preferably to provide a pipe expander which can complete an expanding operation relatively quickly.

The invention may be said to reside in a pipe expander head having a plurality of segments which are coupled together by resilient coupling means, said segments being adapted to be forced radially outwardly to expand a work piece, each segments having at least one expanding portion and the or each expanding portion having a recessed portion to receive a workpiece to be expanded The invention may also be said to reside in a pipe expander, said pipe expander having a plurality of segments which are coupled together by resilient coupling means to form a generally annular disk, said segments being adapted to be forced radially outwardly with respect to one another in order to expand a work piece, said segments each having a plurality of stepped semicircular expanding portions which form annular expanding portions when the segments are coupled together and wherein an annular recess is provided between adjacent stepped portions, and means for driving said segments radially outwardly to perform an expanding operation.

Since the pipe expander and pipe expander head includes a recess between adjacent annular expanding portions the head can be made much thinner than conventional expander heads since a wall of the recess can be used as part of the annular expanding portion to receive a work piece and expand the end of the work piece. Since the expander head can be made much thinner than conventional expander heads, the expander head can be used to expand work pieces where space is at a minimum since the expander head does not project into the work piece as far as conventional expander heads. Therefore, the expander head can be used to expand large diameter work pieces in which space is at a minimum since the smaller diameter expanding portions do not project outwardly of the larger diameter expanding portions to the same extent as in conventional expander heads and therefore the smaller expanding portions do not interfere with the work piece.

Preferably said means for driving the segment comprises a substantially central opening in said generally annular disk, a tapered pin for location in said opening and means for driving said pin into said opening such that as the tapered pin is inserted into said opening, said segments are forced said radially outwardly to cause expansion of said work piece.

Preferably, the means for driving the pin comprises a plurality of teeth arranged on said pin for engagement with a gear assembly and a handle for rotating said gear assembly such that rotation of the gear assembly causes said pin to be driven into and out of said opening in the generally annular disk to force the segments radially outwardly to expand a work piece.

Since the pin is driven by a gear assembly via a handle an expanding operation can be performed in just a few seconds since it is only necessary to crank the handle to drive the pin and expand the expander head to perform the expanding operation.

Preferably, the pin comprises a shank portion which includes said teeth and a tapered head portion which is driven into said opening.

Preferably said opening of the expander head is a tapered opening which matches the taper of the head portion of the pin and the opening being formed by a semi-circular notch, the apex of each segment which forms the annular disk.

Preferably the radially outer circumference of each segment includes an elongate slot for engagement with a stud, said stud supporting the expander head on the pipe expander and enabling radially outward movement of each segment by virtue of relative movement of the stud in said elongate slot.

A preferred embodiment of the invention will be described with reference to the accompanying drawings in which.

Figure 13:
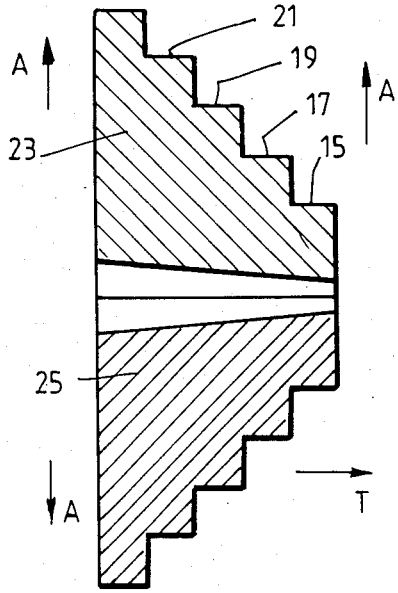
FIG. 13 shows a cross-sectional schematic view of a conventional expander head.

Referring firstly to FIG. 13 which shows a conventional expander head which comprises a plurality of step portions 15, 17, 19 and 21. The step portions 15 to 21 form expander portions for receipt of a generally cylindrical work piece and when segments 23 and 25 are moved radially outwardly in the direction of arrows A, the work piece is expanded. It should be noted that only two segments are shown in FIG. 13. It should also be noted that the expander head shown in FIG. 13 is relatively thick in the direction of arrow T to enable a number of different diameter expanding portions 15, 17, 19 and 21 to be provided on the one expander head. As previously noted this results in limited applicability to work pieces which have a minimum of space or alternatively with conventional expander heads it is necessary to provide an expander head which has only few expanding portions.

Figure 1:
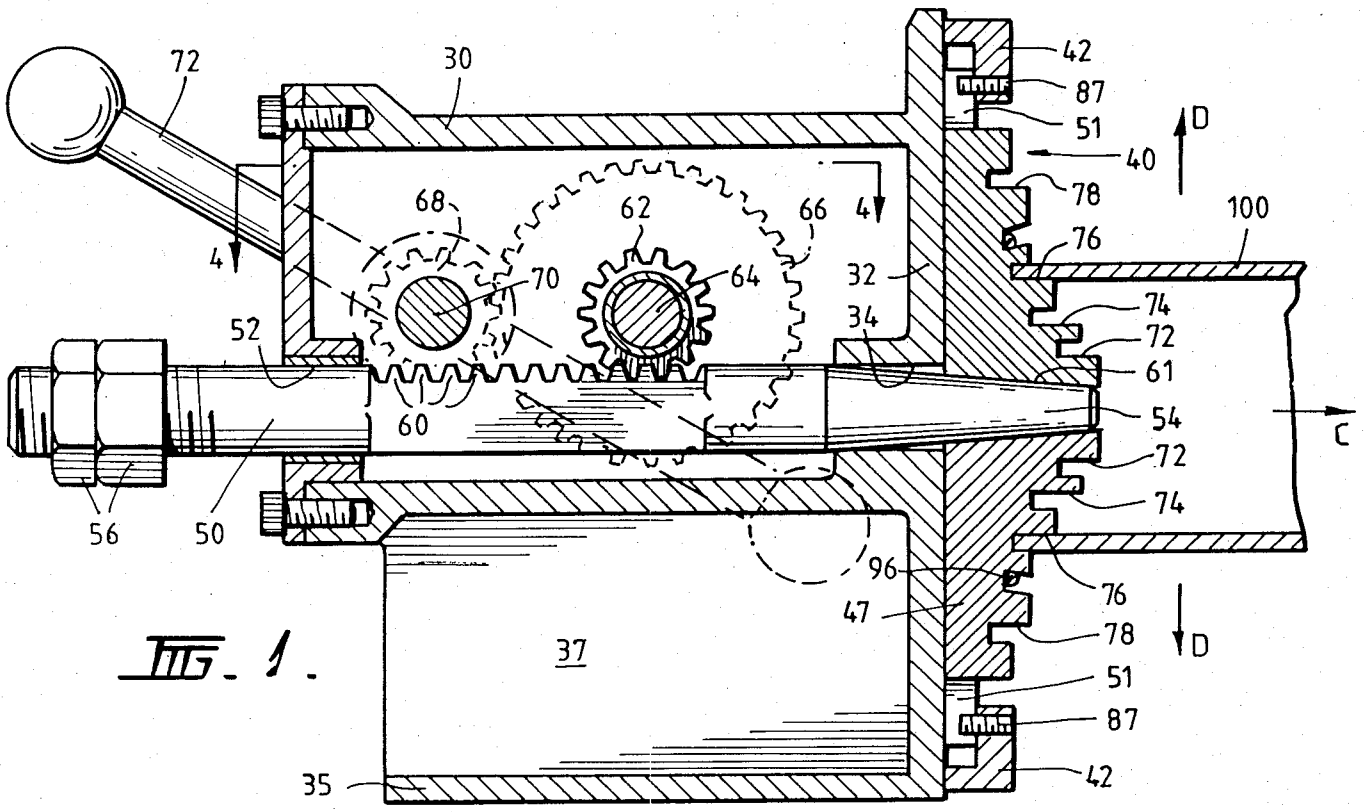
FIG. 1 is a generally cross-sectional view through a pipe expander according to the preferred embodiment of the invention.

Referring now to FIG. 1 which shows a cross-sectional view through a pipe expander according to the preferred embodiment of the invention, there is provided a housing 30 which may be cast from suitable material or which may be formed by other means. The housing 30 includes a generally front flat plate 32 provided with an opening 34 and a base plate 35 and gusset 37 for enabling the expander to be connected to a work bench. An expander head 40 is mounted to front plate 32 by an annular mounting ring 42 which is secured to the front plate 32 by bolts 46 (see FIG. 2).

Figure 2:
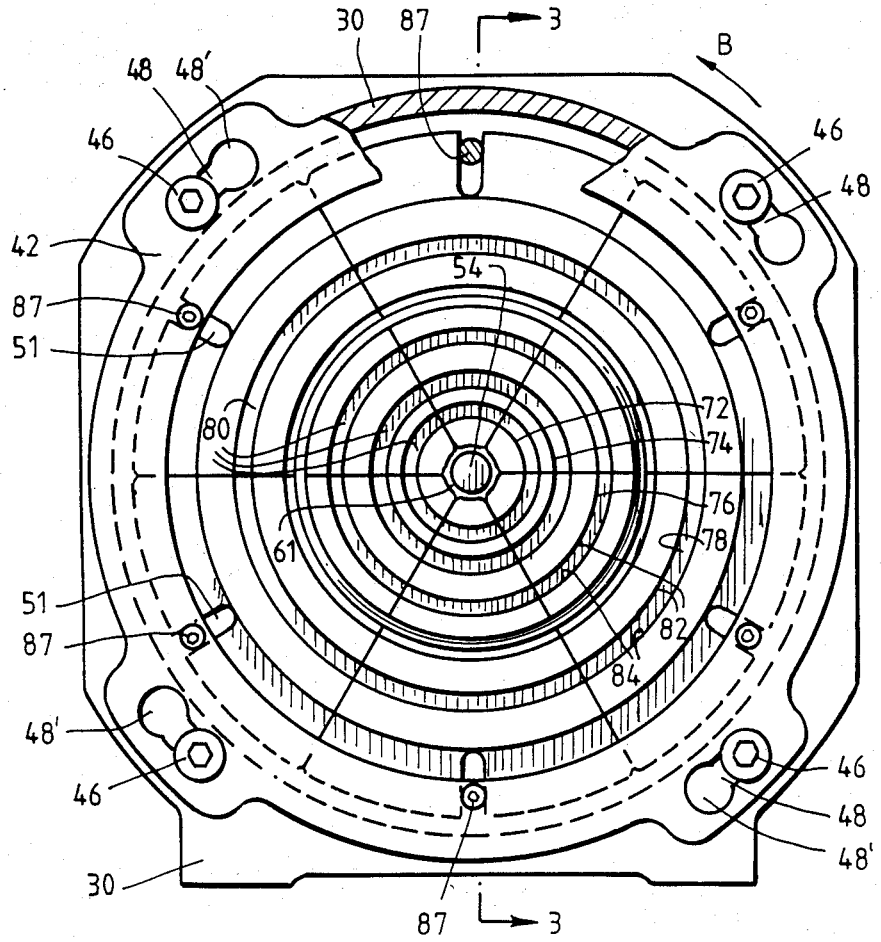
FIG. 2 is a front view of the pipe expander of FIG. 1.
Figure 4:
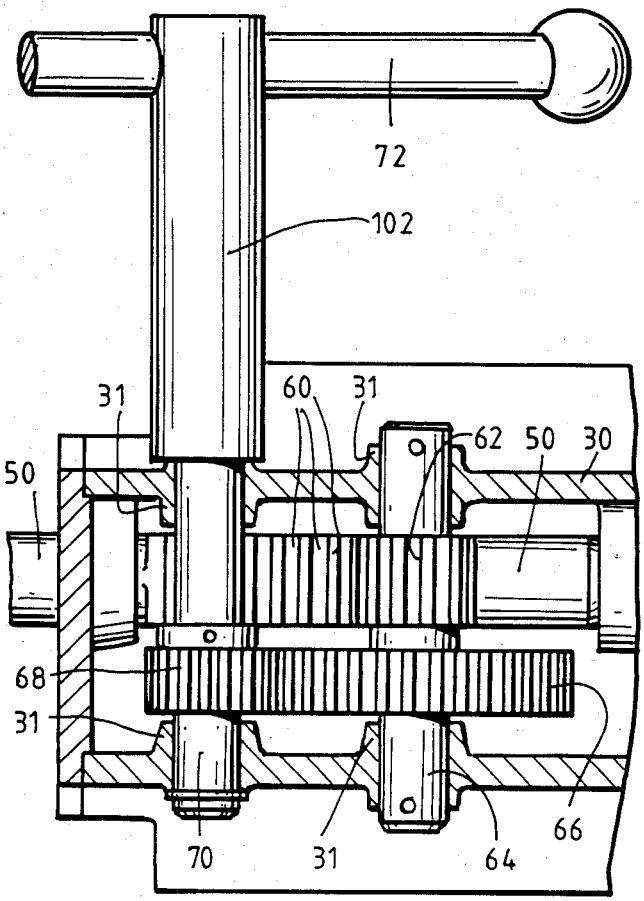
FIG. 4 is a view along the line 4—4 of FIG. 3.

As shown in FIG. 2 the bolts 46 are provided in elongate holes 48 which have an enlarged open end 50 so that the mounting ring 42 can be removed from the front plate 32 by loosening the bolts 46 which are threaded into the front plate 32 and rotating the mounting ring 42 in the direction of arrow B so that the enlarged openings 50 are aligned with the head of the bolts 46 so that the ring 42 can be simply slid of the bolts 46 without the need to completely remove the bolts 46 from the plate 32. A pin 50 is mounted to extend through a rear opening 52 in housing 30 and includes a tapered head 54 which extends through opening 34. The pin 50 has a pair of bolts 56 arranged at its outer end which act as a stop to limit inward movement (to be described hereinafter) of the pin 50. The pin 50 is provided with a plurality of teeth 60 which generally form a rack on the pin 50. The teeth 60 engage a gear 62 which is mounted on a shaft 64. A larger gear 66 is also mounted on shaft 64 and which meshes with a further gear 68 arranged on shaft 70. The shaft 70 is connected to a handle 72. It should be noted that if the housing 30 is cast the housing 30 is provided with bosses 31 (see FIG. 4) which are drilled to support the shafts 64 and 70. If necessary suitable bushings or bearings could be provided in the bosses 31.

Figure 3:
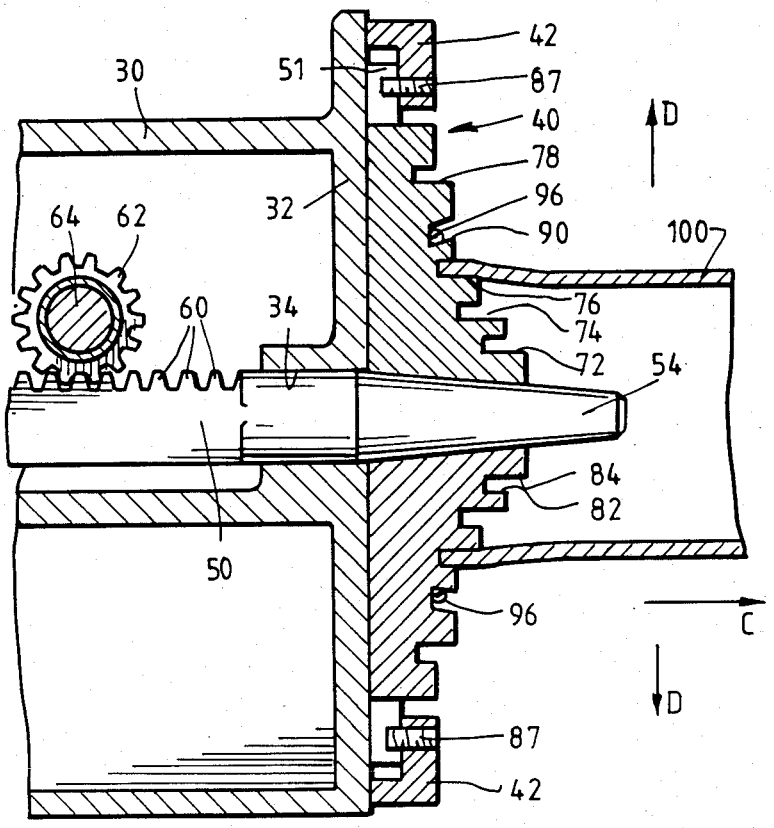
FIG. 3 is a view along the line 3—3 of FIG. 2 and is a generally enlarged view of the front portion of the expander shown in FIG. 1.
Figure 5:
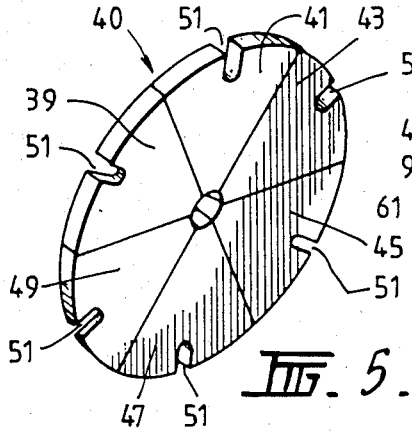
FIGS. 5 to 8 show various views of expander head according to one embodiment of the invention.
Figure 6:
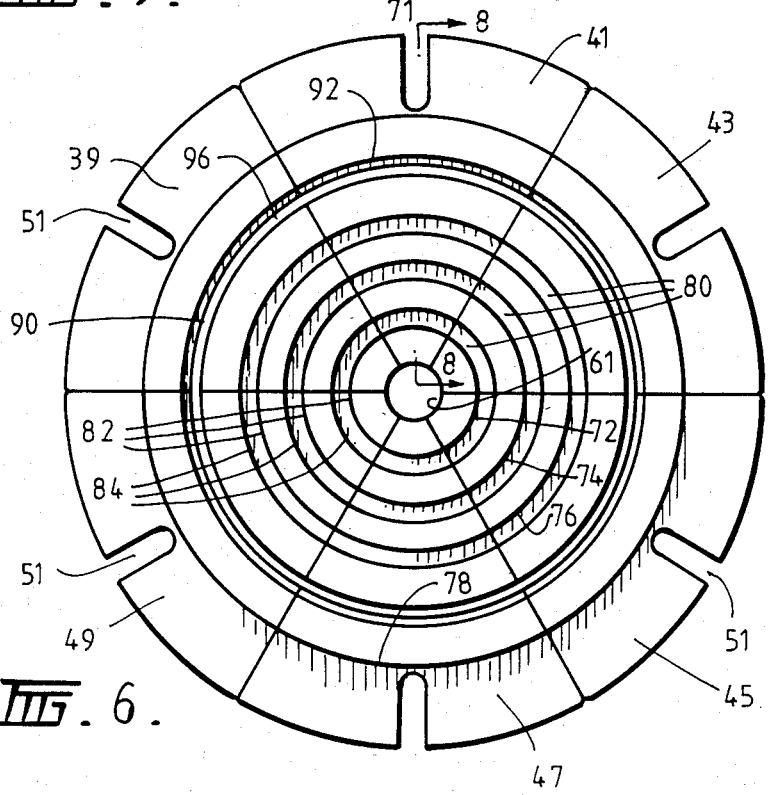
Figure 9:
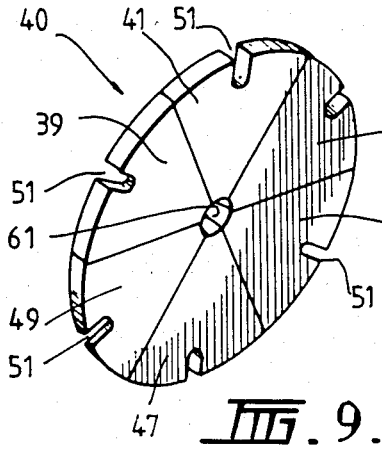
FIGS. 9 to 12 show various views of an expander head according to a second embodiment of the invention.
Figure 12:
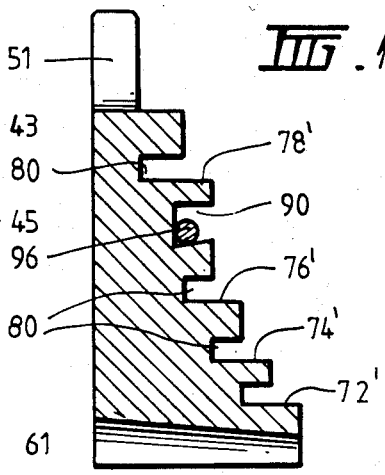
Figure 11:
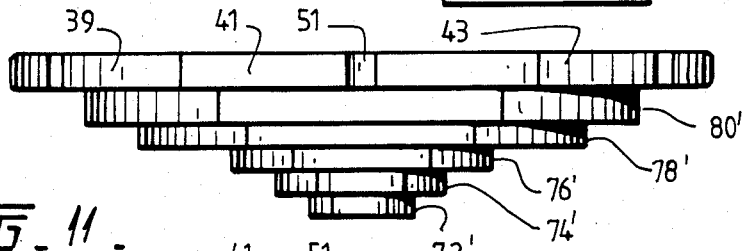
Figure 10:
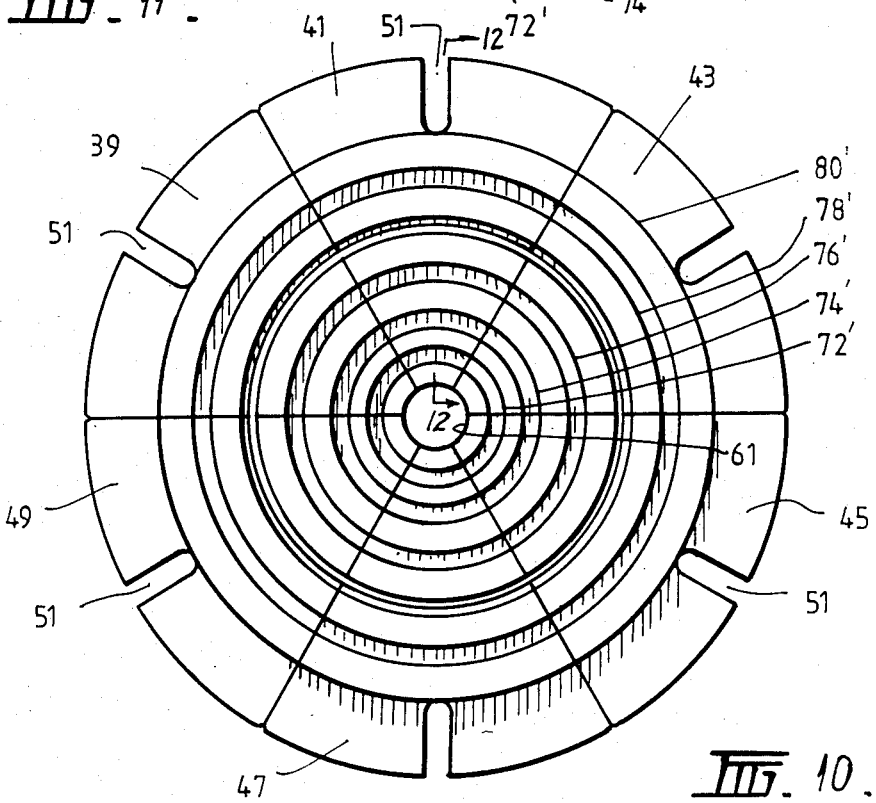

With reference to FIGS. 1, 2, 3 and 5 to 7, the head 40 is formed of six segments 39, 41, 43, 45, 47 and 49. The outer periphery of each segment includes an elongate slot 51 and the inner apex of each segment is inwardly curved so that when the segments are placed together as shown in FIGS. 5 and 6 a central opening 61 is formed. Preferably the opening 61 is tapered as is best seen in FIGS. 1 and 3 to match the taper of head 54 of pin 50.

Figure 8:
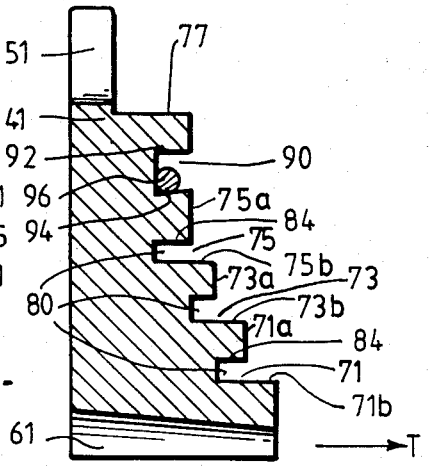
Figure 7:
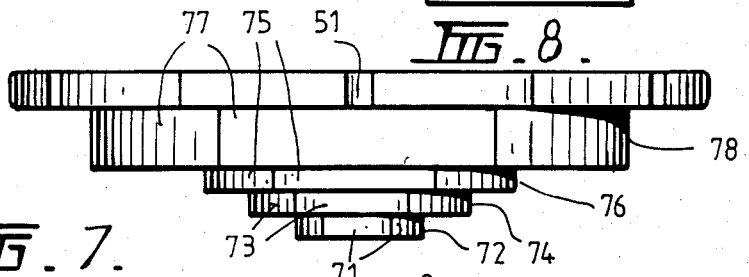

As is best shown in FIGS. 7 and 8 each segment is provided with a plurality of stepped portions 71, 73, 75 and 77. The step portions 71 to 77 are part-circular so that when the segments are placed together in the manner shown in FIG. 6 a plurality of annular step portions 72, 74, 76 and 78 are provided which are of different diameter with the smaller diameter step portion 72 being axially outward of the larger diameter step portions 74, 76 and 78. Each step portion comprises a radial annular surface 71*a*, 73*a*, 75*a*, etc. and an adjacent axial annular surface 71*b*, 73*b*, 75*b* etc. extending at generally right angles to the respective radial annular surface so as to form a step therewith. Provided between each step portion 71, 73, 75 and 77 and therefore between each annular step portion 72, 74, 76 and 78 is generally axially extending a recess 80. The recesses 80 have side walls 82 and 84. The radially inner wall 82 is continuous with the respective surfaces 71*b*, 73*b*, 75*b* etc. of each of the step portions 72, 74, 76 and 78. The surface 71*b*, 73*b*, 75*b* etc. and the side walls 82 of the recesses 80 form expander walls for engaging a work piece in order to expand the work piece.

Since the expander head according to this invention includes recesses, the expander head is much thinner in the direction of arrow T shown in FIG. 8 since part of the expander wall of each expanding portion 72 to 76 is formed in a recess 80. It should be noted that the outermost expanding portion 78 does not require a recess but is merely stepped just before the innermost portion of elongate slots 51.

Each segment 39 to 49 includes a semi-circular channel 90 which forms an annular channel 92 when the segments are joined together. The annular channel 90 has side walls 92 and 94 which are angled outwardly with respect to the axial direction of the head 40 and the channel 90 receives a spring element 96 such as spring wire or an annular expanding coil spring which joins the segments 39 to 49 together and holds the segments together for radial movement as will be described hereinafter.

The diameter of the step portions 72 to 78 can be selected as desired to accord with the diameter of pipes or the like with which the pipe expander is to be used. In the embodiments shown in FIGS. 5 to 8 pipes of four different diameters can be accommodated with a relatively thin expander head. Thus, pipes or other work pieces in which a minimum of space is provided can be used even on the larger diameter expander portions since less room is required in the work piece to receive the smaller expander portions 72, 74 or 76.

Referring to FIGS. 1 and 3, a work piece 100, such as a pipe or the like which is to be joined to another pipe is required to have one end of the pipe expanded so that the other pipe of the same diameter can be slipped into the expanded end and joined to the pipe 100. In order to expand the end of the pipe 100, the pipe 100 is fitted over the expander portion which has a diameter corresponding to the internal diameter of the pipe 100. In the embodiment shown in FIGS. 1 and 3, that portion is the portion 76. In order to expand pipe 100, handle 72 which is coupled to a sleeve 102 joined to shaft 70 is rotated in the appropriate direction to rotate shaft 70 and thereby gear 68 which rotates gear 66 in view of the meshing of the gear 68 and 66. Rotation of gear 66 rotates shaft 64 and gear 62 which is in engagement with the teeth 60 on pin 50. Rotation of gear 62 drives the pin 50 in the direction of arrow C in FIGS. 1 and 3 to force the tapered head 54 of the pin 50 into the tapered opening 61 of the head 40. As the tapered head 54 moves into the opening 61 it forces the segments 39 to 49 of the head 40 radially outward, in the direction of arrow D in FIGS. 1 and 3, against the bias of the spring element 96 which holds the segments 39 to 49 together. As the segments 39 to 49 are driven radially outwardly, the end of pipe 100 is forced radially outwardly to expand the end of the pipe 100 as is shown in FIG. 3. In order to release the pipe 100, the handle 72 which is rotated in the opposite direction to withdraw the pin 50. The pipe 100 is removed so that the segments 39 to 49 can be drawn radially inwardly by the spring element 96 to their original position.

Radial movement of the segments 39 to 49 is accommodated by relative movement between elongate slots 51 and studs 87 which project inwardly from the mounting ring 42. The studs 87 act to prevent rotation of the segments 39 to 49 and thereby assist in retention of the head 40 on the front plate 32 and, in view of the elongate nature of the slots 51 allow relative movement between the segments 39 to 49 and the studs 87.

The head shown in FIGS. 9 to 12 is similar to that shown in FIGS. 5 to 8 except that it is provided with a set of different diameters for the expander portions 72 to 78. Since the head is otherwise identical to that shown in FIGS. 5 to 8 it will not be described in detail herein.

The preferred embodiment of the invention therefore provides an expander head and a pipe expander which can be used with work pieces even where space is minimal and can perform an expanding operation very quickly.

Since modification within the spirit and scope of the invention may readily be effected by persons skilled within the art, it is to be understood that this invention is not limited to the particular embodiment described by way of example hereinabove.

We claim:

1. A pipe expander head, said pipe expander head having a plurality of segments, resilient coupling means for coupling the segments together, said segments being adapted to be forced radially outwardly with respect to one another in order to expand a work piece, said segments each having a plurality of stepped part-circular expanding portions which form annular expanding portions when the segments are coupled together, said annular expanding portions comprising a plurality of radial annular surfaces extending in a generally radial direction of said expander head and a plurality of adjacent axial annular surfaces extending in a generally axial direction so as to form a corresponding plurality of steps therewith, a plurality of annular recesses of preselected length extending in a generally axial direction between axial annular surfaces of adjacent annular expanding portions, each said recess extending from a radial annular surface of one said annular expanding portions and having a radially inner wall extending along its length so as to form a continuation of the axial annular surface of said one annular expanding portion so that the axial thickness of said expander head is reduced by an amount proportional to the sum of the lengths of the walls of each recess.

2. The expander head of claim 1 wherein each segment includes a radial slot at its outer circumference for enabling the expander head to be coupled to a pipe expander.

3. A pipe expander, said pipe expander having a plurality of segments, resilient coupling means for coupling the segments together, said segments being adapted to be forced radially outwardly with respect to one another in order to expand a work piece, said segments each having a plurality of stepped part-circular expanding portions which form annular expanding portions when the segments are coupled together, said annular expanding portions comprising a plurality of radial annular surfaces extending in a generally radial direction of said expander and a plurality of adjacent axial annular surfaces extending in a generally axial direction so as to form a corresponding plurality of steps therewith, a plurality of annular recesses of preselected length extending in a generally axial direction between the axial annular surfaces of adjacent annular expanding portions, each said recess extending from a radial annular surface of one said annular expanding portion and having a radially inner wall extending along its length so as to form a continuation of the axial annular surface of said one annular expanding portion so that the axial thickness of said expander is reduced by an amount proportional to the sum of the lengths of the walls of each recess, and means for driving said segments radially outwardly to perform an expanding operation.

4. The expander according to claim 3 wherein said segments form a disk when coupled together and said means for driving the segment comprises a substantially central opening in said disk, a tapered pin for location in said opening and means for driving said pin into said opening such that as the tapered pin is inserted into said opening, said segments are forced radially outwardly to cause expansion of said work piece.

5. The expander according to claim 4 wherein the means for driving the pin comprises a plurality of teeth arranged on said pin for engagement with a gear assembly and a handle for rotating said gear assembly such that rotation of the gear assembly causes said pin to be driven into and out of said opening in the generally annular disk to force the segments radially outwardly to expand a work piece.

6. The expander according to claim 4 wherein the pin comprises a shank portion which includes said teeth and a tapered head portion which is driven into said opening.

7. The expander according to claim 4 wherein said opening of the expander head is a tapered opening which matches the taper of the head portion of the pin and the opening being formed by a semi-circular notch at the apex of each segment which forms the annular disk.

8. The expander according to claim 4 wherein the radially outer circumference of each segment includes an elongate slot for engagment with a stud, said stud supporting the expander head on the pipe expander and enabling radially outward movement of each segment by virtue of relative movement of the stud in said elongate slot.

* * * * *

UNITED STATES PATENT AND TRADEMARK OFFICE

CERTIFICATE OF CORRECTION

PATENT NO. : 4,733,551

DATED : March 29, 1988

INVENTOR(S) : Warren E. Bryant, et al.

It is certified that error appears in the above-identified patent and that said Letters Patent is hereby corrected as shown below:

Column 1, Line 55, After "expanded" insert --.-- (period)

Column 4, Lines 11,12, Change "is generally axially extending a recess 80." to --is a generally axially extending recess 80.--

Column 4, Line 15, Change "surface" to --surfaces--

Column 5, Line 17, After "slots 51" insert --,-- (comma)

Signed and Sealed this

Eighth Day of November, 1988

*Attest:*

DONALD J. QUIGG

*Attesting Officer*

*Commissioner of Patents and Trademarks*